US008657015B2

(12) United States Patent
Patel

(10) Patent No.: US 8,657,015 B2
(45) Date of Patent: Feb. 25, 2014

(54) INTELLIGENT COMPLETION SYSTEM FOR EXTENDED REACH DRILLING WELLS

(75) Inventor: Dinesh R. Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 439 days.

(21) Appl. No.: 13/115,436

(22) Filed: May 25, 2011

(65) Prior Publication Data

US 2011/0297393 A1 Dec. 8, 2011

Related U.S. Application Data

(60) Provisional application No. 61/348,531, filed on May 26, 2010.

(51) Int. Cl.
*E21B 34/06* (2006.01)

(52) U.S. Cl.
USPC ..... 166/373; 166/386; 166/316; 166/325

(58) Field of Classification Search
USPC ..... 166/386, 373, 316, 325
See application file for complete search history.

(56) References Cited

U.S. PATENT DOCUMENTS

| | | | | |
|---|---|---|---|---|
| 7,849,925 | B2 | 12/2010 | Patel | |
| 7,870,906 | B2 | 1/2011 | Ali | |
| 7,900,705 | B2 * | 3/2011 | Patel | 166/319 |
| 8,037,940 | B2 * | 10/2011 | Patel et al. | 166/386 |
| 8,336,627 | B2 * | 12/2012 | Patel et al. | 166/325 |
| 8,408,314 | B2 * | 4/2013 | Patel et al. | 166/373 |
| 2002/0189815 | A1 | 12/2002 | Johnson et al. | |
| 2006/0027377 | A1 | 2/2006 | Schoonderbeek et al. | |
| 2007/0227727 | A1 * | 10/2007 | Patel et al. | 166/250.01 |
| 2009/0065199 | A1 | 3/2009 | Patel | |
| 2009/0078428 | A1 | 3/2009 | Ali | |
| 2009/0211769 | A1 | 8/2009 | Assal | |
| 2010/0175894 | A1 | 7/2010 | Debard | |
| 2010/0200291 | A1 * | 8/2010 | Patel et al. | 174/70 R |
| 2011/0198097 | A1 | 8/2011 | Moen | |

OTHER PUBLICATIONS

International Search Report and Written Opinion of the International Searching Authority dated Dec. 20, 2011 for PCT Application No. PCT/US2011/037888 filed May 25, 2011.

* cited by examiner

*Primary Examiner* — Nicole Coy
(74) *Attorney, Agent, or Firm* — David G. Matthews; Brandon S. Clark; Robb D. Edmonds

(57) ABSTRACT

Apparatus and methods for completing, treating, and/or producing a wellbore are provided. The apparatus can include a tubular body defining an inner bore, one or more injection inflow control devices, and one or more production inflow control devices. The one or more injection inflow control devices can include one or more first check valves in fluid communication with the inner bore, with each first check valve being configured to allow fluid to flow therethrough from the inner bore to a region of the wellbore, and to substantially block a reverse fluid flow therethrough. The one or more production inflow control devices can include one or more second check valves coupled to the tubular body, each second check valve being configured to allow fluid to flow therethrough from the wellbore to the inner bore and to substantially block a reverse fluid flow therethrough.

20 Claims, 10 Drawing Sheets

INTELLIGENT COMPLETION SYSTEM FOR EXTENDED REACH DRILLING WELLS

BACKGROUND

In recent years, the development and deployment of inflow control devices (hereinafter, "ICDs") has improved horizontal well production and reserve recovery in new and existing hydrocarbon wells. ICD technology has increased reservoir drainage area, reduced water and/or gas coning occurrences, and increased overall hydrocarbon production rates. In longer, highly-deviated horizontal wells, however, a continuing difficulty is the existence of non-uniform flow profiles along the length of the horizontal section, especially as the well is depleted. This problem typically arises as a result of non-uniform drawdown applied to the reservoir along the length of the horizontal section, but also can result from variations in reservoir pressure and the overall permeability of the hydrocarbon formation. Non-uniform flow profiles can lead to premature water or gas breakthrough, screen plugging, and/or erosion in sand control wells, and can severely diminish well life and profitability. Likewise, in horizontal injection wells, the same phenomenon applied in reverse can result in uneven distribution of injection fluids that leave parts of the reservoir un-swept, resulting in a loss of recoverable hydrocarbons.

Additional problems have resulted from a push toward increasing wellbore depths to, for example, 40,000 feet and beyond. Wells of such lengths are commonly referred to as extended reach drilling ("ERD") wells. Generally, completing such wells for efficient treatment and production has proved challenging, and can result in the farthest distal region or "toe" of the horizontal section being left open or uncompleted. Any length of wellbore that is not completed represents an area of reduced production efficiency. Furthermore, completing such wells conventionally requires multiple runs of differently-configured completion strings for formation treating (e.g., acid introduction), flowback, and production. Therefore, what is needed is a completion system and a method for running a completion system that avoids non-uniform drawdown pressures, while also extending to the distal end of the wellbore and requires less, or even a single, run(s) of production tubing.

SUMMARY

One or more apparatus for completing a wellbore are provided herein. The apparatus can include a tubular body defining an inner bore, one or more injection inflow control devices, and one or more production inflow control devices. The one or more injection inflow control devices can include one or more first check valves and/or flow constrictors in fluid communication with the inner bore, with each first check valve or flow constrictor being configured to allow fluid to flow therethrough from the inner bore to a region of the wellbore, and to substantially block a reverse fluid flow therethrough. The one or more production inflow control devices can include one or more second check valves or flow constrictors coupled to the tubular body, each second check valve or flow constrictor being configured to allow fluid to flow therethrough from the wellbore to the inner bore and to substantially block a reverse fluid flow therethrough.

The apparatus can be a completion system for a wellbore. The completion system can include one or more distal completion segments including one or more injection inflow control devices and one or more production inflow control devices. The one or more production inflow control devices can be configured to allow fluid to flow from within the one or more distal completion segments to a region outside the one or more distal completion segments, and to prevent reverse flow therethrough. The one or more production inflow control devices can be configured to allow fluid to flow from the region outside the one or more distal completion segments to within the one or more distal completion segments, and to prevent reverse fluid flow therethrough. The completion system can also include a proximal completion segment coupled with at least one of the one or more distal completion segments.

A method for completing a wellbore is also provided. The method can include running one or more distal completion segments into a wellbore, and running a proximal completion segment into the wellbore using a production tubing string after running the one or more distal completion segments. The method can also include coupling a distal end of the production tubing string with the one or more distal completion segments in the wellbore.

BRIEF DESCRIPTION OF THE DRAWINGS

So that the recited features can be understood in detail, a more particular description, briefly summarized above, can be had by reference to one or more embodiments, some of which are illustrated in the appended drawings. It is to be noted, however, that the appended drawings illustrate only typical embodiments and are therefore not to be considered limiting of its scope, for the invention can admit to other equally effective embodiments.

DETAILED DESCRIPTION

Figure 1:
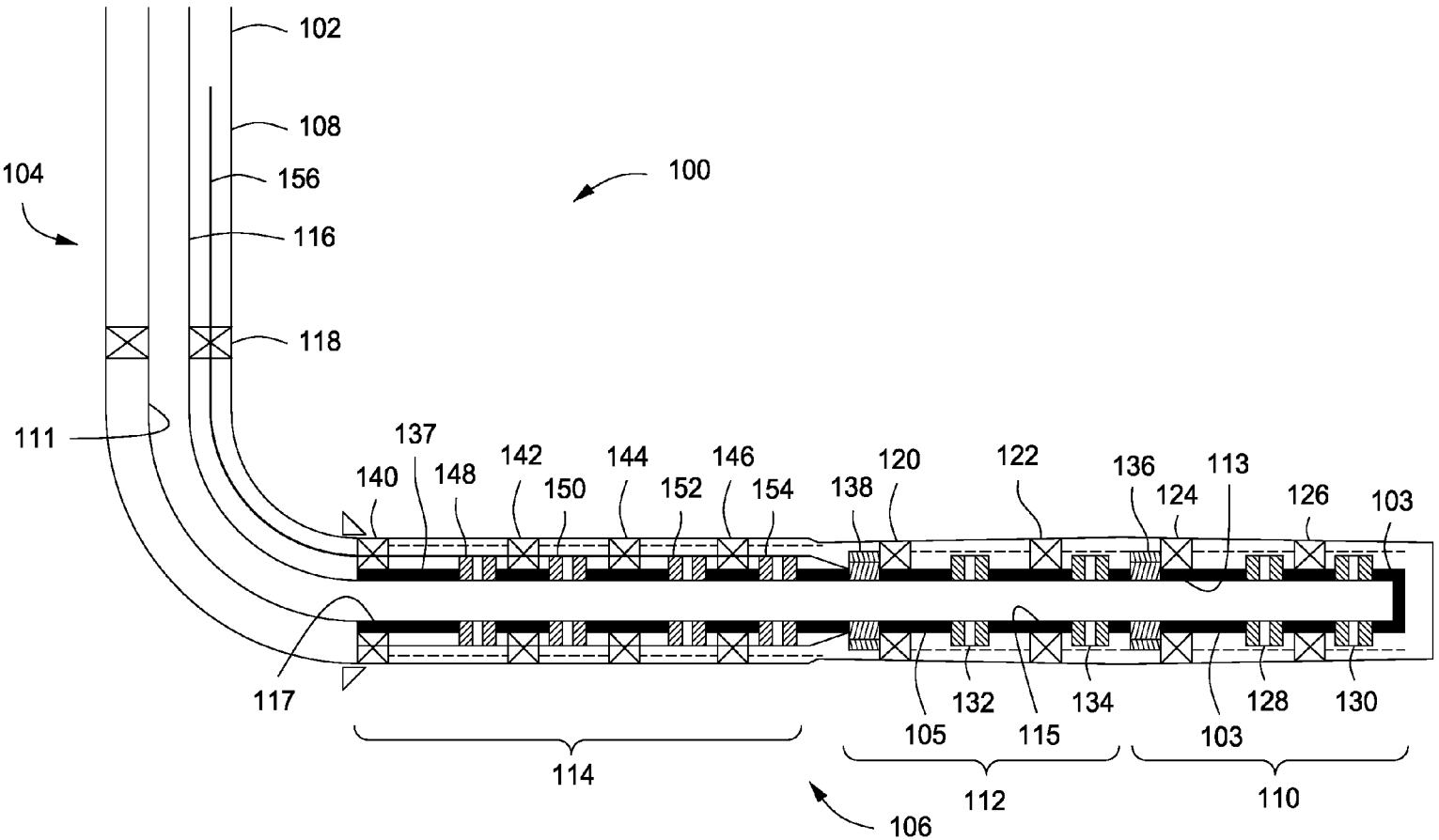
FIG. 1 depicts an illustrative completion system, according to one or more embodiments described.

FIG. 1 depicts a completion system 100 disposed in a wellbore 102, according to one or more embodiments. The wellbore 102 can be deviated, as shown, having a substantially vertical portion 104 and a substantially horizontal portion 106. Further, the wellbore 102 can include a casing 108; however, in some instances, the wellbore 102 or any portion(s) thereof can remain uncased. The completion system 100 generally includes one or more distal completion segments (two are shown: 110, 112) and at least one proximal completion segment 114. Production tubing 116 can extend in the wellbore 102 from the surface (not shown), down the vertical portion 104, and through one or more production packers 118, which can be any suitable type of mechanical and/or swellable packer disposed in the vertical portion 104. The production tubing 116 can be coupled to and/or extend at least partially through one or more of the completion segments 110, 112, 114. The production tubing 116 can be coupled to the proximal completion segment 114 and can be configured to be run into the wellbore 102 therewith. Each of the production tubing 116, the distal completion segments 110, 112, and the proximal completion segment 114 defines an inner bore 111, 113, 115, 117, respectively. When the completion system 100 is fully-deployed, each inner bore 111, 113, 115, 117 can be in fluid communication with one another, allowing for fluid flow to or from the surface through the completion system 100.

The distal completion segments 110, 112 can each include a tubular body 103, 105, which defines the respective inner bore 113, 115 thereof. Further, the distal completion segments 110, 112 can each include one or more flow control valves 128, 130, 132, 134, which are configured to allow or prevent fluid flow out of the inner bore 113, 115, depending on whether the flow control valves 128, 130, 132, 134 are open or closed. The flow control valves 128, 130, 132, 134 can be initially opened by dropping a ball, dart, or other structure into the wellbore 102 and then subsequently closed and/or opened by a shifting tool or other type of actuating device conveyed on slick line, wireline, coiled tubing or pipe, as are known in the art. Additionally, the flow control valves 128, 130, 132, 134 can be remotely-actuated via electrical signal, hydraulic signal, fiber optic signals, wireless telemetry, combinations thereof, or the like, or can be mechanically-actuated by a shifting tool or actuating device conveyed on slick line, wireline, coiled tubing or, pipe.

The distal completion segments 110, 112, can also include one or more production inflow control devices ("ICDs") and one or more injection ICDs (neither shown), coupled to the tubular bodies 103, 105. The ICDs can each include one or more check valves or flow restrictors configured to allow fluid with a predetermined pressure differential to proceed one way through the valve, while substantially blocking fluid from reversing flow therethrough. The flow control valves 128, 130, 132, 134 can control the introduction of fluid to the ICDs, allowing for sequential treatment and/or production of the wellbore 102 proximal each of the distal completion segments 110, 112. Further, as both production and injection ICDs can be included in a single distal completion segment 110, 112, each such distal completion segment 110, 112 can be used in injection, flow back, and production operations, without requiring removal and reconfiguration of the distal completion segments 110, 112. The distal completion segments 110, 112 can also include a plurality of isolation packers 120, 122, 124, 126, with the flow control valves 128, 130, 132, 134 being, for example, disposed between axially-adjacent isolation packers 120, 122, 124, 126 as shown. It will be appreciated, however, that intervals between axially-adjacent isolation packers 120, 122, 124, 126 can include one, none, or multiple flow control valves 130, 132, 134, 138.

Each of the distal completion segments 110, 112 can also include an axial coupling 136, 138, as shown, proximal an axial extent of the respective distal completion segment 110, 112. It will be appreciated that one or more of the distal completion segments 110, 112 can include no axial couplings, while others can include two axial couplings, as desired. The axial couplings 136, 138 can each be a threaded coupling, a sheer coupling, stab in coupling with seal or without seal, or the like, and can be configured to allow the distal completion segments 110, 112 to be run into and positioned in the wellbore 102 and then coupled together in sequence. After the proximal-most distal completion segment (as shown, 112) is positioned and coupled to the remaining distal completion segment(s) (as shown, 110), the coupling 138 of the proximal-most distal completion segment 112 can be configured to couple with the production tubing 116 and/or the proximal completion segment 114 for further completion of the wellbore 102.

Considering the proximal completion segment 114 in more detail, the proximal completion segment 114 can include a tubular body 137 and one or more isolation packers (four are shown: 140, 142, 144, 146) extending between the body 137 and the casing 108. One or more flow control valves (four are shown: 148, 150, 152, 154) can be coupled to the body 137 and can be positioned axially adjacent one of the isolation packers 140, 142, 144, 146, for example, between adjacent pairs thereof. Multiple flow control valves 148, 150, 152, 154 can be disposed between adjacent pairs of the isolation packers 140, 142, 144, 146 and/or one or more adjacent pairs of the isolation packers 140, 142, 144, 146 can have no flow control valves 148, 150, 152, 154 disposed therebetween.

The flow control valves 148, 150, 152, 154 can be configured to allow or prevent fluid flow therethrough into or out of the inner bore 117, depending on whether each valve 148, 150, 152, 154 is open or closed. An opto-electric cable and/or a hydraulic control line 156 can extend along the production tubing 116 to the proximal completion segment 114, allowing topside, remote control of mechanical actuation of the flow control valves 148, 150, 152, 154 via fiber optic, electric, or hydraulic signals through the cable/line 156. In other embodiments, however, the flow control valves 148, 150, 152, 154 can be configured to actuate by receiving a ball, dart, or another object dropped from the surface. The flow control valves 148, 150, 152, 154 can also be configured to actuate by engaging a shifting tool or other actuating apparatus (not shown) conveyed on slickline, wireline, coiled tubing or pipe. Further, the flow control valves 148, 150, 152, 154 can be configured to actuate via ball drop, initially, with subsequent actuations by mechanical engagement with a shifting tool or by remote actuation.

As with the distal completion segments 110, 112, the proximal completion segment 114 can include one or more production ICDs and one or more injection ICDs (none shown), coupled to the tubular bodies 103, 105, respectively, and in fluid communication with the flow control valves 148, 150, 152, 154. The ICDs can each include one or more check valves and/or flow constrictors configured to allow fluid to flow one way therethrough, while substantially blocking fluid from reversing flow therethrough. Accordingly, the proximal completion segment 114 can be employed for injection, flow back, and production operations, without requiring removal and additional runs of the proximal completion segment 114 and/or production tubing 116. When the proximal and distal completion segments 110, 112, 114 include both production and injection ICDs, the completion system 100 can be referred to as a "single run" completion.

The one or more distal completion segments 110, 112 can be run into the wellbore 102 prior to and separate from the proximal completion segment 114 and the production tubing 116. For example, a first distal completion segment 110 can be run in the wellbore 102 via drill pipe, coiled tubing, tractor on wireline, or the like (not shown), which is then removed. Such pipe, tubing, or lines can be limited as to how far into the horizontal portion 106 they are capable of deploying the first distal completion segment 110; accordingly, a tractor, as is known in the art, can be deployed into the wellbore 102 and can engage the first distal completion segment 110 and complete the deployment thereof. A second distal completion segment 112 can then be deployed in a similar fashion, until it abuts the first distal completion segment 110. The second distal completion segment 112 can then be coupled to the first distal completion segment 110 via the coupling 136, such that the inner bores 113, 115 are in fluid communication with each other. This process can be repeated for as many additional distal completion segments (none shown) as desired. Thereafter, the production tubing 116 can be employed to run the proximal completion segment 114 into the wellbore 102. The distal end of the proximal completion segment 114 can then be coupled to the proximal end of the proximal-most distal completion segment (as shown, 112), for example, via the coupling 138.

The flow control valves 148, 150, 152, 154 of the proximal completion segment 114 and the flow control valves 128, 130, 132, 134 of the distal completion segments 110, 112 can all be configured to actuate, for example, via dropping a ball, dart, or another like structure. For simplicity of description, however, such structures configured to be dropped into the wellbore 102 will be generically referred to herein as a "ball," with the understanding that, as the term is used herein, a "ball" or "drop ball" can include a dart or any other structure dropped into the completion system 100 for the purposes of actuating a valve. Accordingly, the distal-most flow control valve 130 can be configured to receive a drop ball of the smallest diameter, with the next most distal flow control valve 128 being configured to receive a larger ball, and so on, with each flow control valve 128, 130, 132, 134, 148, 150, 152, 154 being sized to receive a slightly smaller ball than the next (proceeding from distal to proximal). In other embodiments, all balls can have substantially the same diameter.

As such, each flow control valve 128, 130, 132, 134, 148, 150, 152, 154 can be actuated in sequence by dropping progressively larger balls through the production tubing 116, or by dropping the same size balls therethrough. However, the flow control valves 128, 130, 132, 134, 148, 150, 152, 154 can be a mixture of mechanically-actuated flow control valves and ball-drop-actuated flow control valves. For example, the flow control valves 148, 150, 152, 154 of the proximal completion segment 114 can be mechanically-actuated, while the flow control valves 128, 130, 132, 134 of the distal completion segments 110, 112 can be ball-drop-actuated. It will be appreciated, however, that any combination of actuation mechanisms for the flow control valves 128, 130, 132, 134, 148, 150, 152, 154 is within the scope of the disclosure. Further, the balls or darts for the ball-drop-actuated flow control valves 148, 150, 152, 154 can be flowed back to surface during production, or balls or darts that allow flow from below to surface can stay in wellbore 102. Additionally, the balls or darts can be pulled out or milled for providing passage for flow. Moreover, the balls or darts can be made from degradable or dissolvable materials that can disintegrate over time when in contact with various metals or other materials dissolved in water or other fluids, such as calcium, magnesium, a combination thereof, various other alloys disintegrated in water. The rate at which the ball or dart disintegrates can be controlled by selection and composition of the material out of which the ball or dart is constructed and/or the composition and concentration of the disintegrating fluid. Indeed, one or more of the flow control valves 128, 130, 132, 134, 148, 150, 152, 154 can be configured to receive a ball or dart for initial opening and, thereafter, can be actuated open or closed with other implements, such as mechanical engagement with a shifting tool and/or interventionless or remote actuation via hydraulics, electrical connection, or the like.

Figure 2:
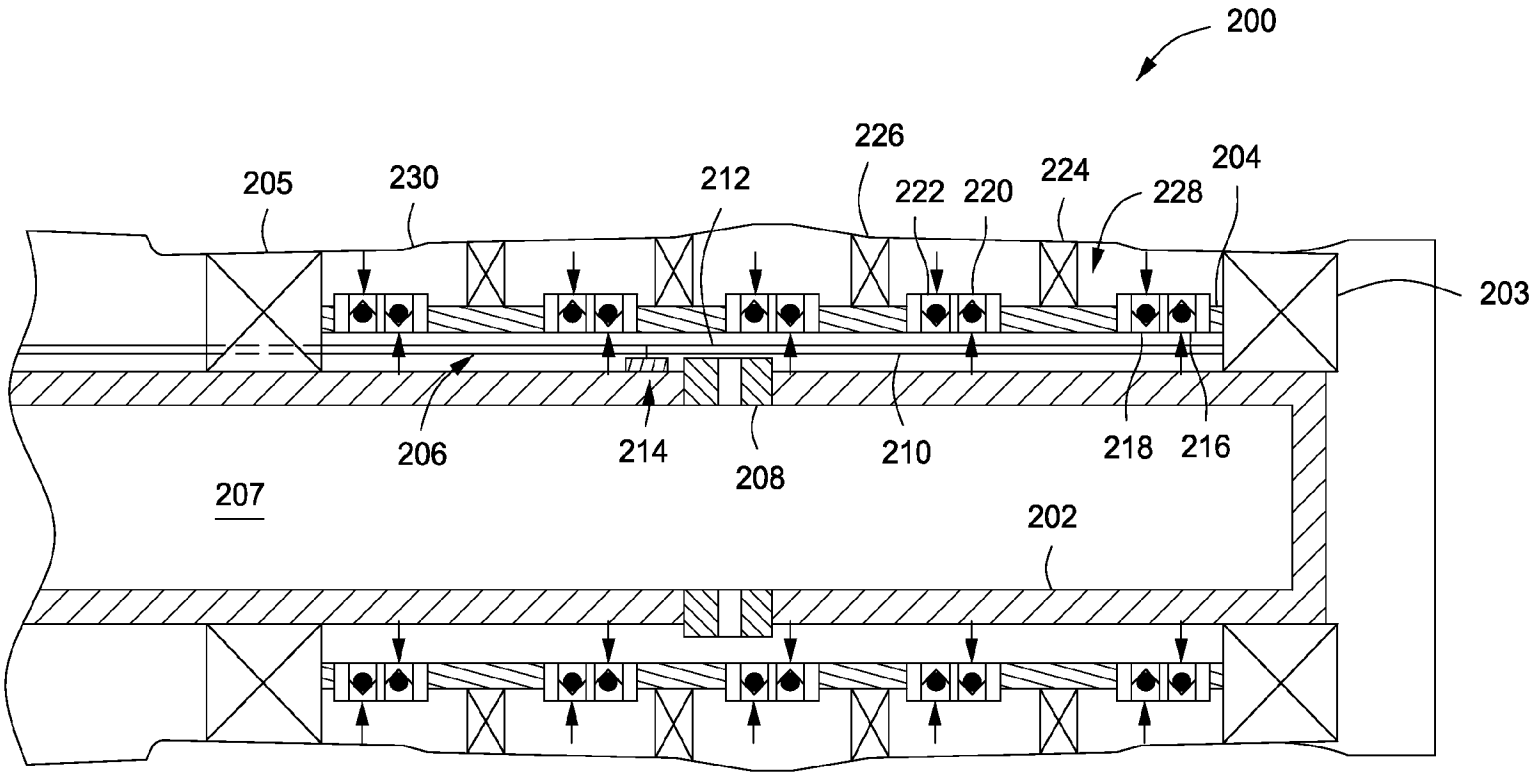
FIG. 2 depicts an illustrative completion segment, according to one or more embodiments described.

FIG. 2 illustrates a completion segment 200, according to one or more embodiments. The completion segment 200 includes a body, which includes a tubular base 202 and an outer body or sleeve 204. The outer body 204 can extend entirely around the base 202, or can extend only partially therearound. Isolation packers 203, 205 can be disposed proximal opposite axial extends of the base 202, with the isolation packers 203, 205 extending radially-outward therefrom. The outer body 204 can also be coupled to the isolation backers 203, 205 such that the isolation packers 203, 205 couple the outer body 204 to the base 202. However, the outer body 204 can be coupled directly to the base 202 via, for example, structural struts or the equivalent.

The base 202 can define an inner bore 207 therein, which can provide the primary flowpath for the completion segment 200. The outer body 204 can be spaced radially apart from the base 202, thereby defining a secondary flowpath 206 therebetween. Further, the completion segment 200 can include one or more mechanically-actuated flow control valves 208 coupled to the base 202, thereby providing selective fluid flow between the inner bore 207 and the secondary flowpath 206. The flow control valve 208 can include an actuator/sensor assembly 214, which is connected with the surface (not shown) via one or more control lines 210 and/or one or more signal lines 212. The signal line 210 can receive and send status signals from/to the surface, and the control lines 210 can provide electrical current, hydraulic fluid or the like, to provide energy for actuating (i.e., opening and closing) the flow control valve 208. Further, the signal line 210 and control line 212 can extend at least partially through the secondary flowpath 206 and through at least one of the isolation packers 203, 205, as shown, for example, via apertures or other cable-bypass structures as are generally known in the art. A generally annular region 228 can be defined radially outside of the outer body 204. The region 228 can be defined on its radial-outside by a generally cylindrical structure 230, which can be a slotted liner, a sand screen, gravel, or any other wall found in the wellbore 102 (FIG. 1). To protect the cylindrical structure 230 and divert axially-flowing fluids, one or more swell constrictors (eight are shown, but for ease of reference, only two are numbered: 224, 226) can be disposed at axial intervals along the outer body 204. The swell constrictors 224, 226 can be any swell constrictors known in the art to divert axial flow and/or protect the integrity of the structure 230 during injection and/or production.

The completion segment 200 can also include one or more injection ICDs (ten are shown; however, for ease of reference, only two are numbered: 216, 220) coupled to the outer body 204. The injection ICDs 216, 220 can each include one or more check valves (not shown), which allow fluid flow at a predetermined pressure to proceed radially-outward from the secondary flowpath 206, through the outer body 204, and to the region 228. The completion segment 200 can also include one or more production ICDs (ten are shown; however, for ease of reference, only two are numbered: 218, 222) coupled to the outer body 204. The production ICDs 218, 222 can each include one or more check valves (not shown), which allow fluid flow at a predetermined pressure to proceeding radially-inward from the region 228, through the outer body 204, and to the secondary flowpath 206.

The ICDs 216, 218, 220, 222 can be disposed in pairs, with one production ICD 218, 222 and one injection ICD 216, 220 in each pair. At least one pair of ICDs 216, 218 can be disposed between the isolation packer 203 and the swell constrictor 224. Further, at least one pair of ICDs 220, 222 can be disposed between adjacent swell constrictors 224, 226. In some embodiments, multiple pairs of ICDs 216, 218, 220, 222, only a single (either production or injection) ICD 216, 218, 220, 222, or no ICDs can be disposed in a given interval between any two adjacent swell constrictors 224, 226 and/or in the interval between the swell constrictor 224 and the packer 203.

Figure 3:
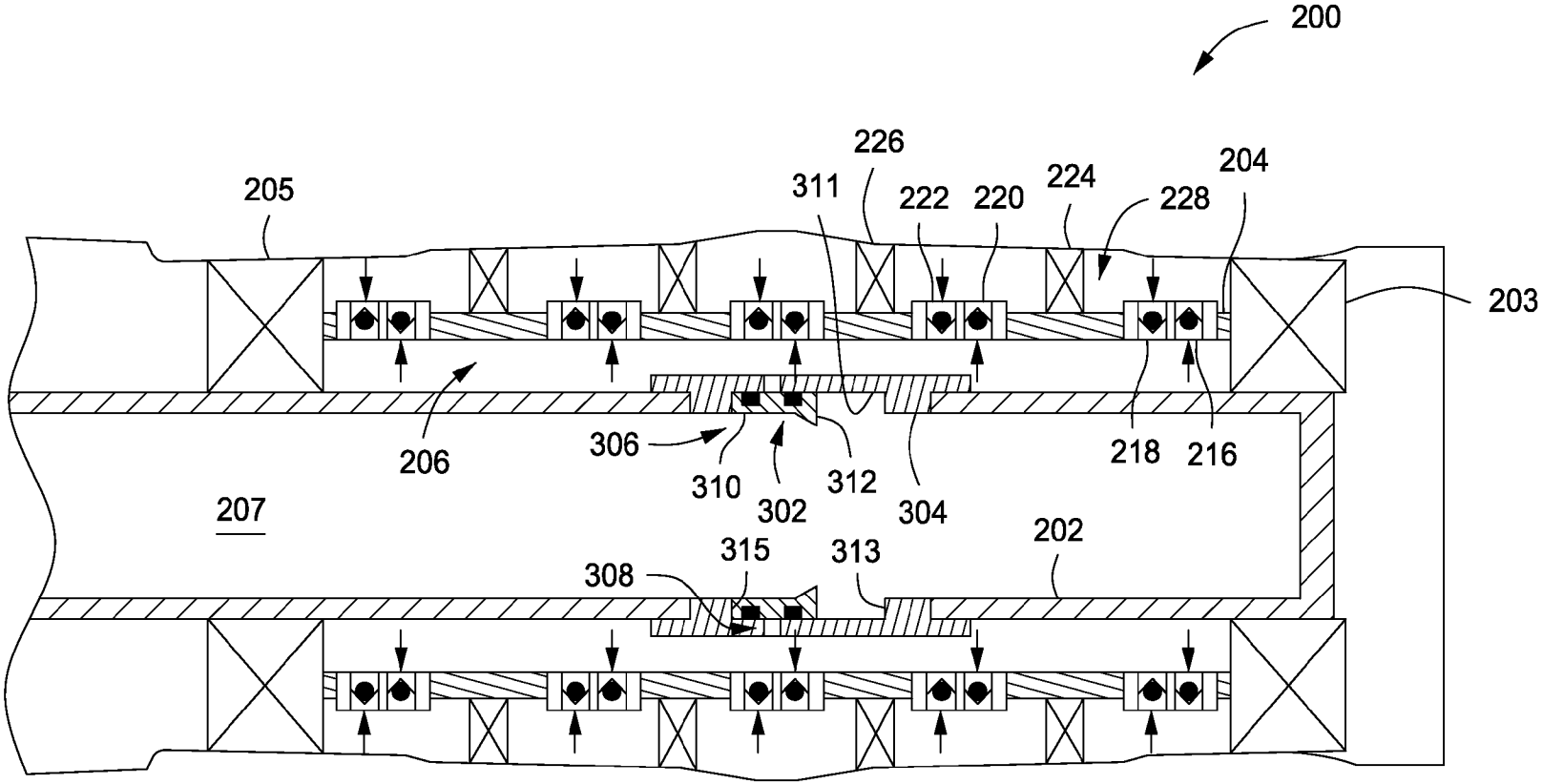
FIG. 3 depicts another illustrative completion segment with a flow control valve in a closed configuration, according to one or more embodiments described.
Figure 4:
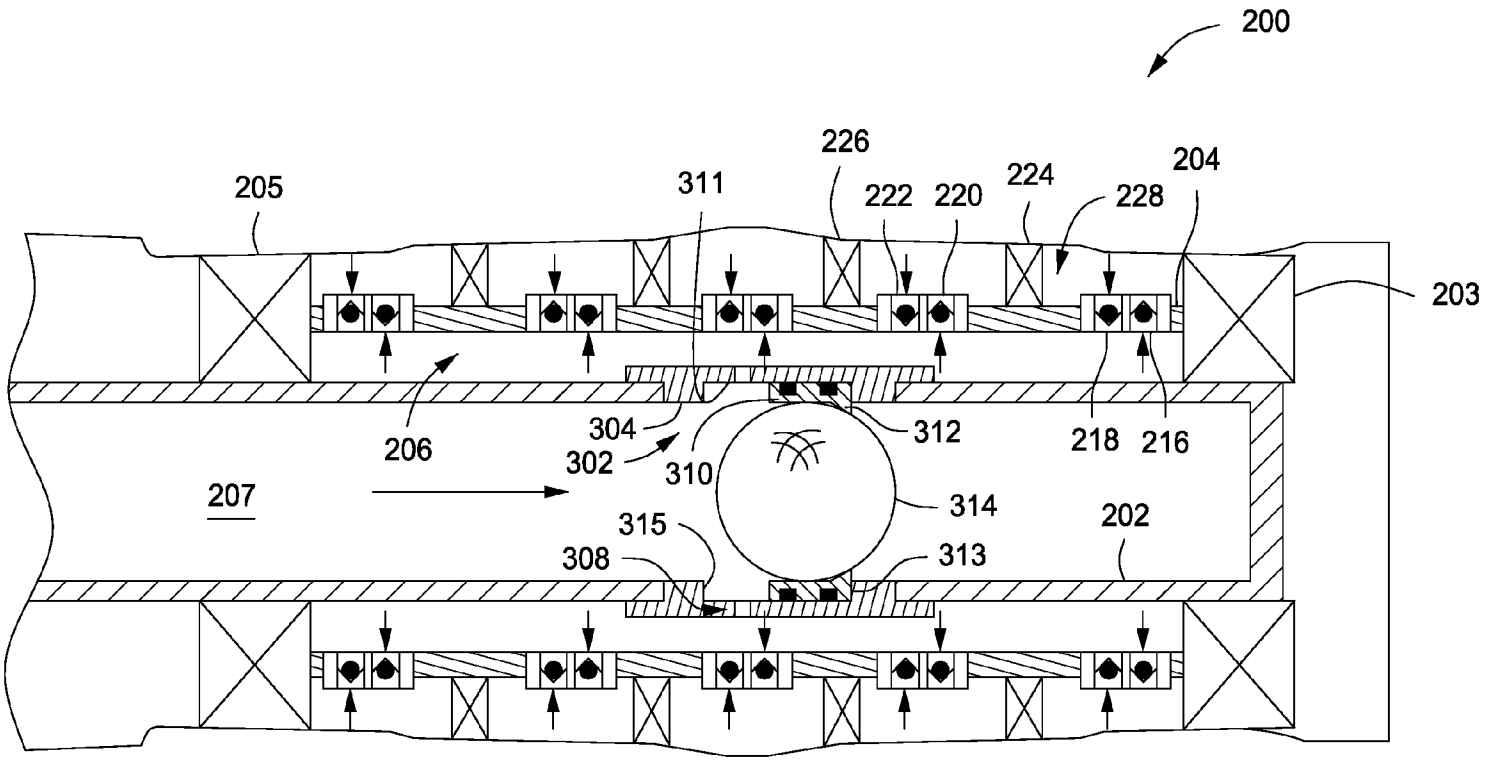
FIG. 4 depicts the completion segment of FIG. 3 with the flow control valve in an open configuration, according to one or more embodiments described.

FIGS. 3 and 4 depict another embodiment of the completion segment 200, in accordance with one or more embodiments. As shown, the completion segment 200 can include a ball-actuated flow control valve 302. The flow control valve 302 can be coupled to the base 202, for example, in a slot, aperture, or other opening 306 defined in the base 202. Further, the flow control valve 302 can include a plate 304, which can form a sleeve and can span the opening 306. The plate 304 can be welded, brazed, fastened, integrally-formed with or otherwise coupled to the base 202 such that a seal therebetween is formed. The plate 304 can define an orifice 308 extending therethrough, with the orifice 308 being configured to fluidly communicate between the inner bore 207 and the secondary flowpath 206.

The flow control valve 302 can also include a valve element 310 capable of covering and sealing the orifice 308, thereby closing the flow control valve 302, and of moving to at least partially uncover the orifice 308, thereby opening the flow control valve 302. The valve element 310 can be a slidable sleeve 310, as shown. As such, the flow control valve 302 can define a recess 311 in the plate 304. The sleeve 310 can be disposed in the recess 311 to avoid obstructing the inner bore 207. Furthermore, the recess 311 can be defined on its axial ends by shoulders 313, 315 of the plate 304, which can constrain the axial motion of the sleeve 310. The flow control valve 302 can also include a ball seat 312 extending radially-inward from the base 202 into the inner bore 207.

When it is desired to open the flow control valve 302 and thus provide fluid communication between the inner bore 207 and the secondary flowpath 206, a ball 314 can be deployed into the inner bore 207 as shown in FIG. 4. The ball 314 can be deployed, for example, via the production tubing 116 (FIG. 1). The ball 314 can engage the ball seat 312 and can form a fluid tight seal therewith, thus obstructing fluid flow in a distal direction D through the segment 300. The momentum of the ball 314 travelling in the fluid in the inner bore 207, as well as subsequent pressure increases in the bore 207, can urge the sleeve 310 to move in the direction D, thereby unsealing and uncovering the orifice 308. As such, the flow control valve 302 can be opened by the ball 314, thereby providing fluid communication between the inner bore 207 and the secondary flowpath 206. Subsequent injection, flow back, and/or production processes can then proceed, utilizing the check valves of the ICDs 216, 218, 220, 222.

Figure 5:
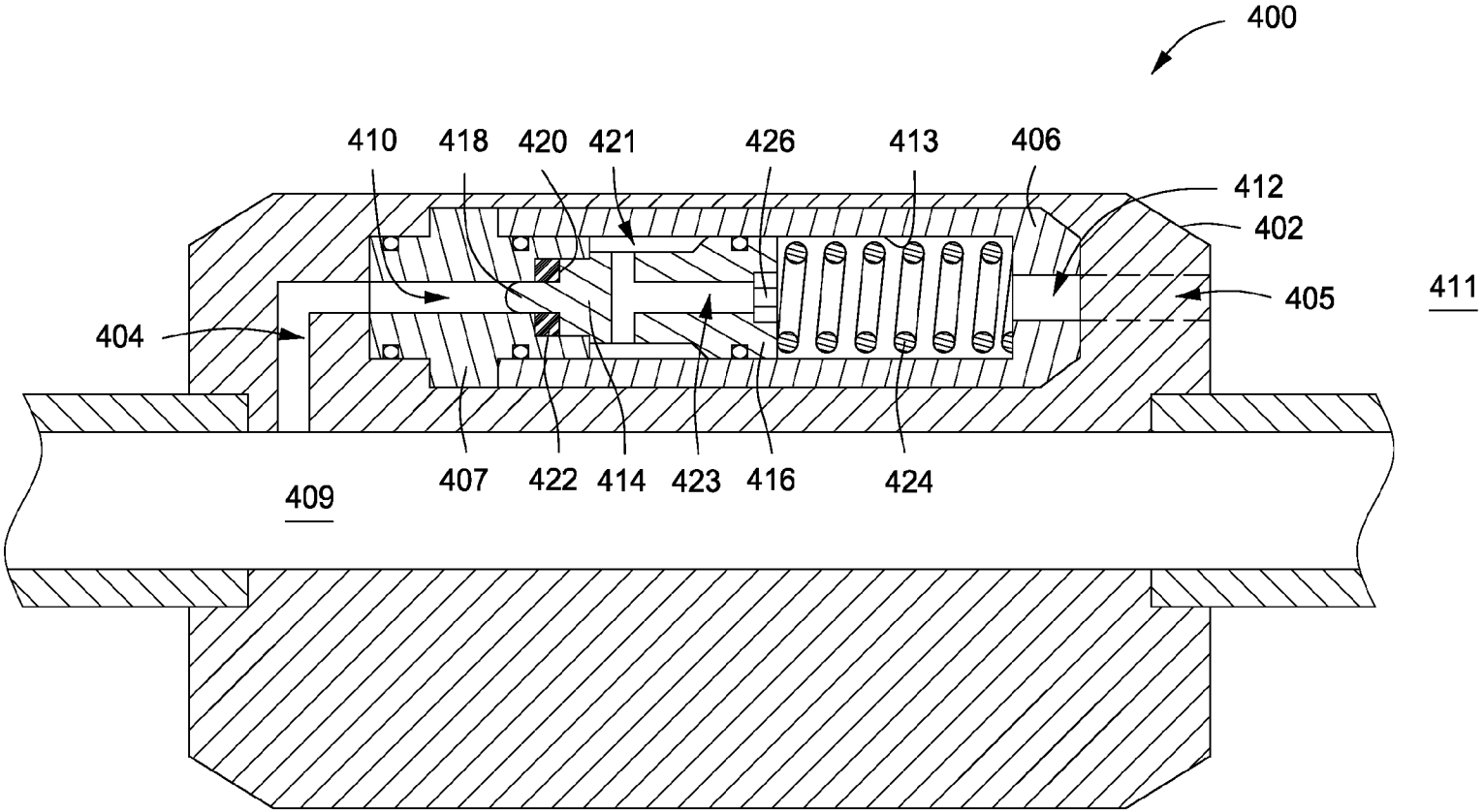
FIG. 5 depicts an illustrative inflow control device in a closed configuration, according to one or more embodiments described.
Figure 6:
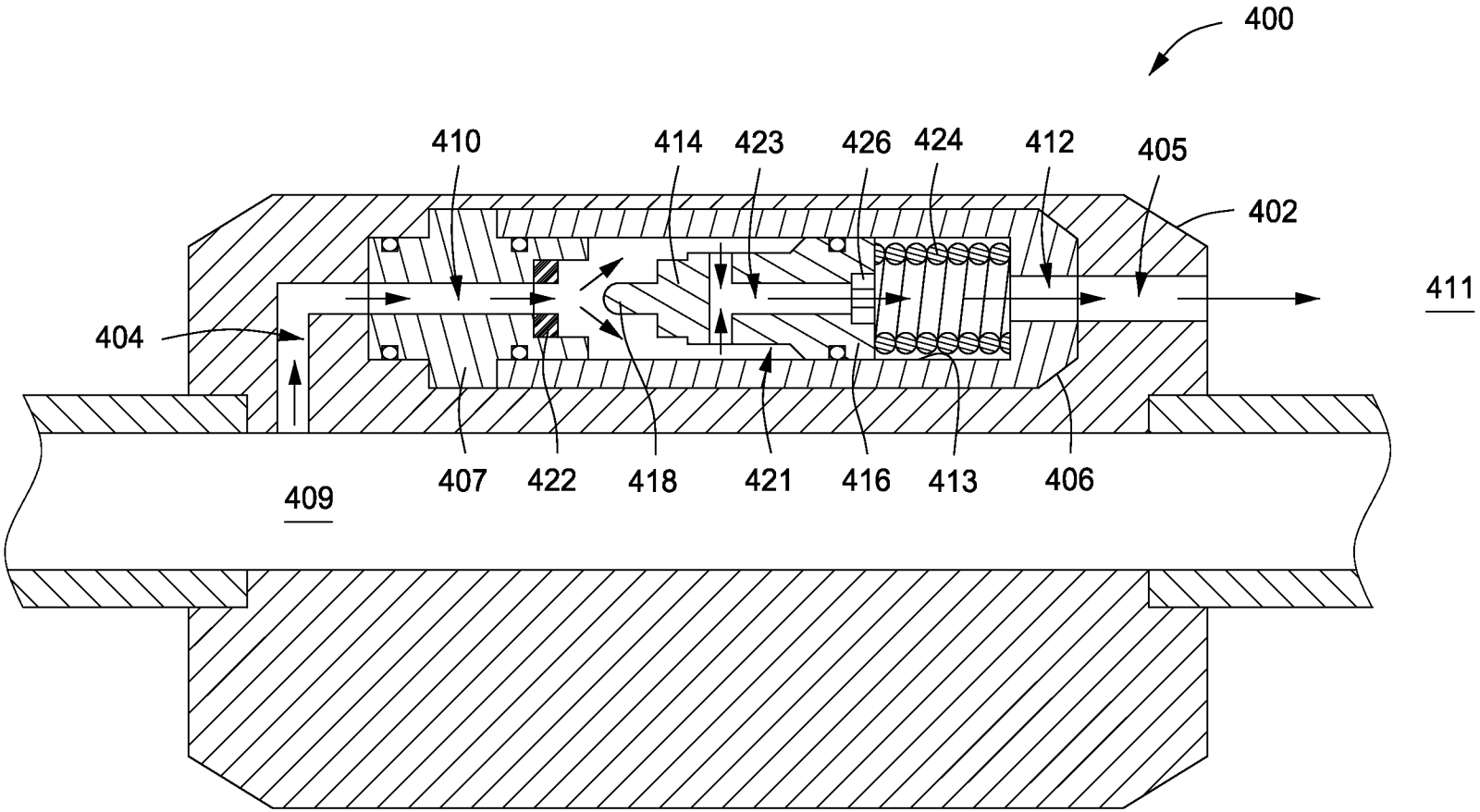
FIG. 6 depicts the inflow control device of FIG. 5 in an open configuration, according to one or more embodiments described.

FIGS. 5 and 6 depict an illustrative ICD 400, according to one or more embodiments. It will be appreciated that the ICD 400 can be configured and employed for production, injection, and/or flow back operations and used in completion systems such as the completion system 100 (FIG. 1) or others and/or in conjunction with the completion segment 200 (FIGS. 2-4). The ICD 400 generally includes a housing or "carrier" 402, with one or more check valves (i.e., a check valve "cartridge") 406 disposed therein. It will be appreciated that a second check valve (not shown) can be disposed in the bottom (as shown) portion of the carrier 402. Moreover, the carrier 402 defines an inlet flow passage 404 and an outlet flow passage 405, both of which can extend through the carrier 402 and fluidly communicate with the check valve 406. The inlet flow passage 404 is also in fluid communication with a main flow path 409, while the outlet flow passage 405 fluidly communicates with an area 411 exterior to the carrier 402.

The check valve 406 can include an outlet 412 in fluid communication with the outlet flow passage 405, and an inlet 410 in fluid communication with the main flow path 409 via the inlet flow passage 404. Moreover, the check valve 406 can include a valve seat 407 and a movable plunger 414. The valve seat 407 can be positioned and configured to seal with an inner wall 413 of the check valve 406, such that a seal between the two is created. Further, the valve seat 407 can define at least part of the inlet 410 therethrough. The plunger 414 can include a generally cylindrical finger 418 extending therefrom and sized to be snugly but movably disposed in the inlet 410. Further, a face seal 422 can be disposed between the valve seat 407 and an annular face 420 of the plunger 414. Accordingly, when the finger 418 is received into the inlet 410, the annular face 420 and the valve seat 407 can form a fluid tight seal, e.g., using the face seal 422.

The check valve 406 can also include a biasing member 424 (e.g., a spring) coupled to the plunger 414. The biasing member 424 can be compressed, such that it resiliently pushes the plunger 414 toward the valve seat 407, thereby providing a default position for the plunger 414, where the plunger 414 is sealed against the valve seat 407. In other embodiments, the biasing member 424 can be expanded from its natural length, rather than compressed, to bias the plunger 414 toward the valve seat 407. Further, the biasing member 424 can include multiple biasing elements, which can be either in tension or compression. Other biasing members 424 are also contemplated herein, such as expandable diaphragms, hydraulic/pneumatic assemblies, and the like.

A recess 421 can be defined around a portion of the plunger 414, while a base 416 of the plunger 414 can be sealed with the wall 413 of the check valve 406. Further, the plunger 414 can include a through-passage 423 extending radially from the recess 421 and axially through the plunger 414. Additionally, the check valve 406 can include a choke 426 disposed at a downstream end of the through-passage 423, as shown. The choke 426 can be, for example, a converging or converging/diverging nozzle, which provides for a generally constant mass flow rate, despite pressure fluctuations within a certain range downstream of the choke 426. In operation, when there is no positive pressure differential between the inlet 410 and the outlet 412 (i.e., the outlet 412 is at the same or greater pressure than the inlet 410), the finger 418 can be disposed in the inlet 410 and/or the plunger 414 can be sealed with the valve seat 407. As such, without a predetermined pressure differential, the check valve 406 remains closed, preventing fluid flow therethrough, as shown in FIG. 5.

However, as shown in FIG. 6, when a fluid pressure in the main flow path 409 is elevated, a positive pressure differential (i.e., pressure in the inlet 10 is greater than pressure in the outlet 412) across the plunger 414 develops. The positive pressure differential thus applies a net force on the plunger 414, counter to the force applied by the biasing member 424. Upon introduction of a predetermined pressure level (i.e., a desired injection, formation, production, etc. pressure) in the inlet 410, the force applied by the net force can be sufficient to overcome the biasing force applied by the biasing member 424, the plunger 414 can move away from the valve seat 407 and can break the seal between the valve seat 207 and the plunger 414. Once the seal is broken and/or the finger 418 is ejected from the inlet 410, fluid flow can proceed through the inlet 410 and into the recess 421. The flow from the recess 421 can then be directed through the through-passage 423, through the choke 426, past the biasing member 426, out the outlet 412 of the check valve 406, and out the outlet flow passage 405 of the carrier 402 into the exterior area 411.

It will be appreciated that the ICD 400 prevents reverse flow therethrough from the exterior area 411 to the main flowpath 409. Indeed, if a negative pressure differential develops (i.e., pressure in the outlet 412 is greater than pressure in the inlet 410), the plunger 414 is urged to seal more tightly against the valve seat 407. Barring component failure, this can result in the check valve 406 remaining closed, thereby preventing back flow.

Figure 7:
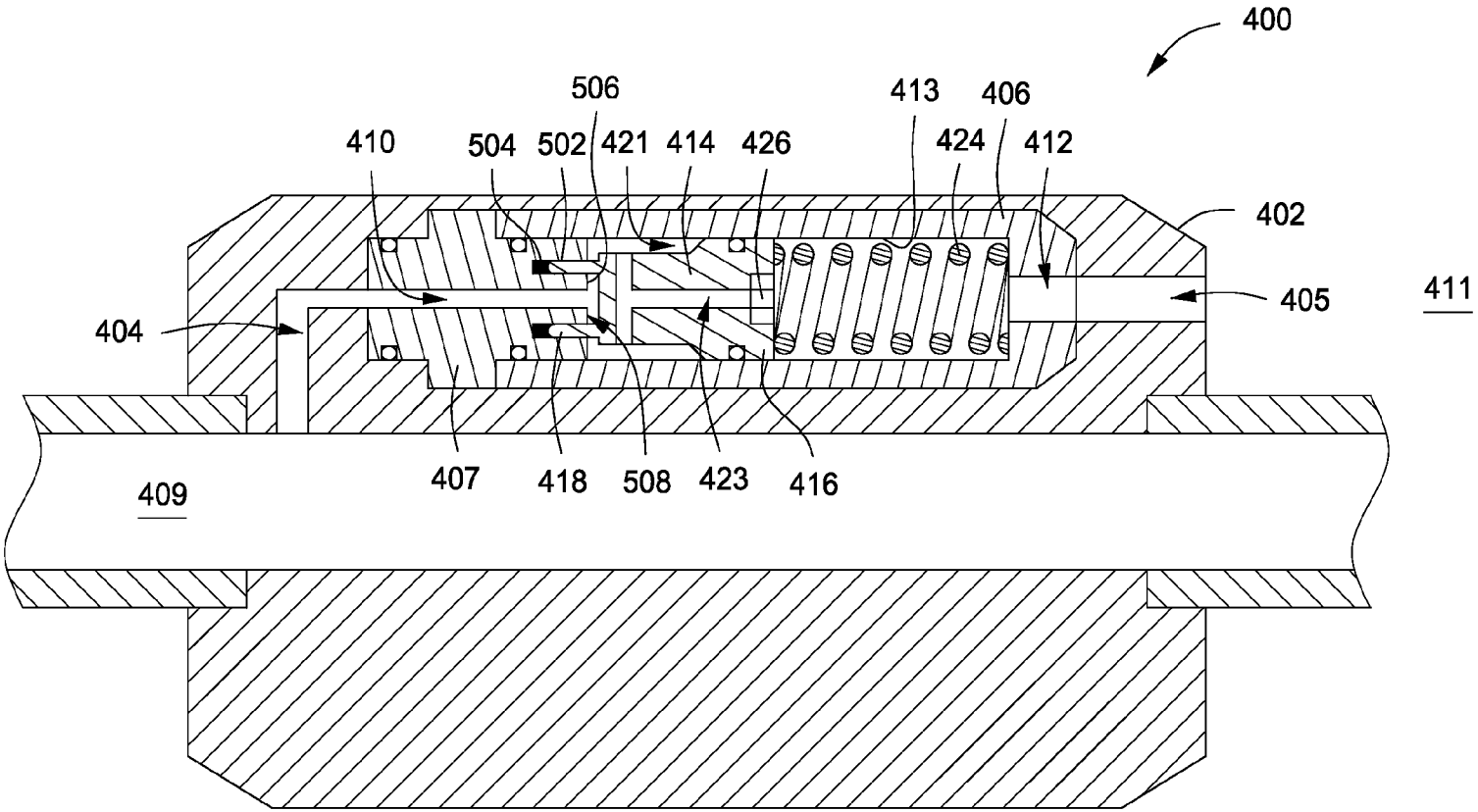
FIG. 7 depicts another embodiment of the inflow control device, according to one or more embodiments described.

FIG. 7 depicts another embodiment of the ICD 400, with the finger 418 being annular, rather than generally cylindrical as shown and described above with reference to FIGS. 5 and 6. Accordingly, the valve seat 407 can include an annular groove 502 sized and positioned to receive the finger 418. A face seal 504 can be disposed in the annular groove 502, for example, the bottom of the groove 502, as shown. Thus, when the check valve 406 is closed (as illustrated), the finger 418 of the plunger 414 can engage and seal against the face seal 504 of the valve seat 407. As such, the finger 418 can block fluid flow from coming out of the inlet 410 by sealing around an end 506 of the inlet 410.

Figure 8:
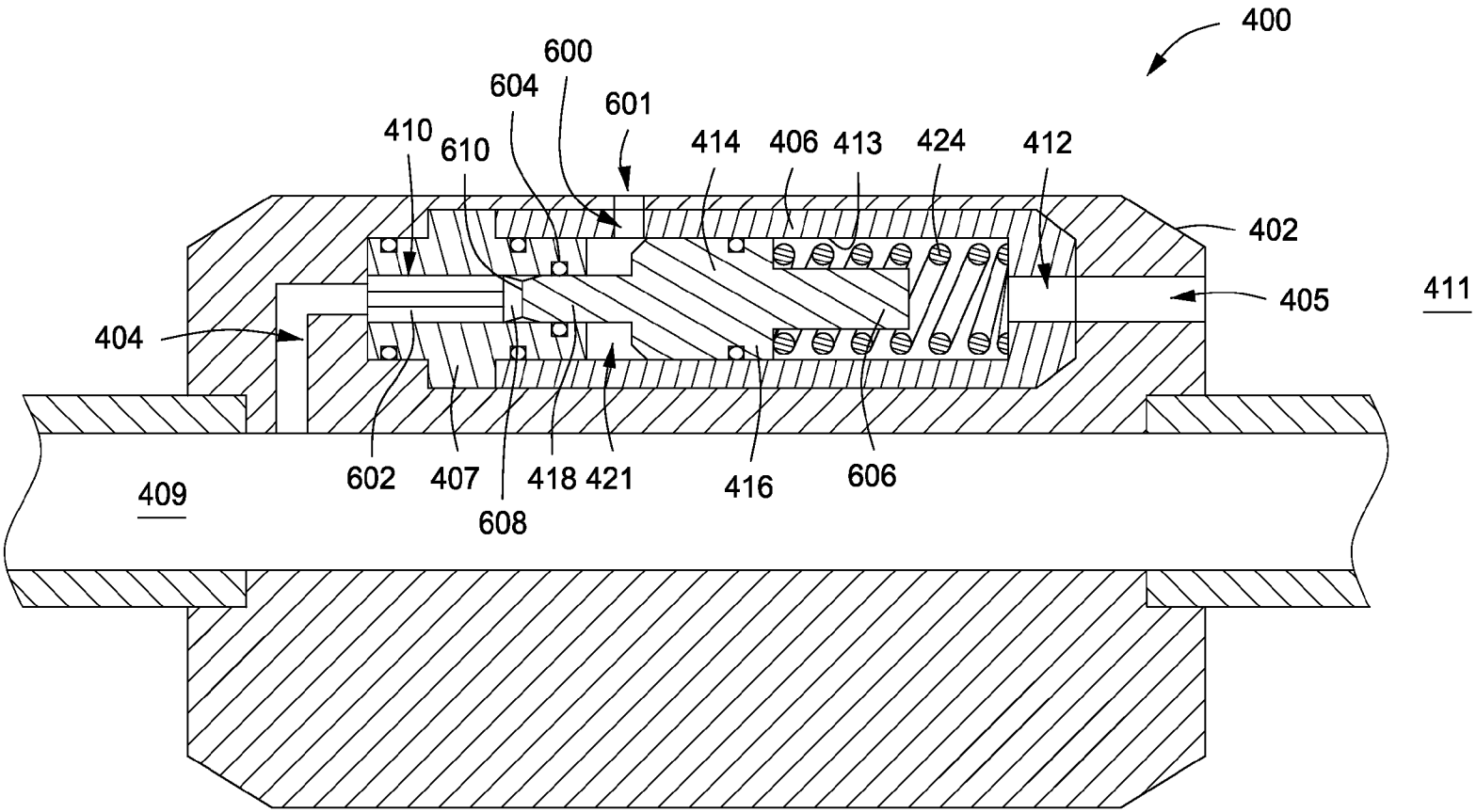
FIG. 8 depicts yet another embodiment of the inflow control device with the inflow control device in a closed configuration, according to one or more embodiments described.
Figure 9:
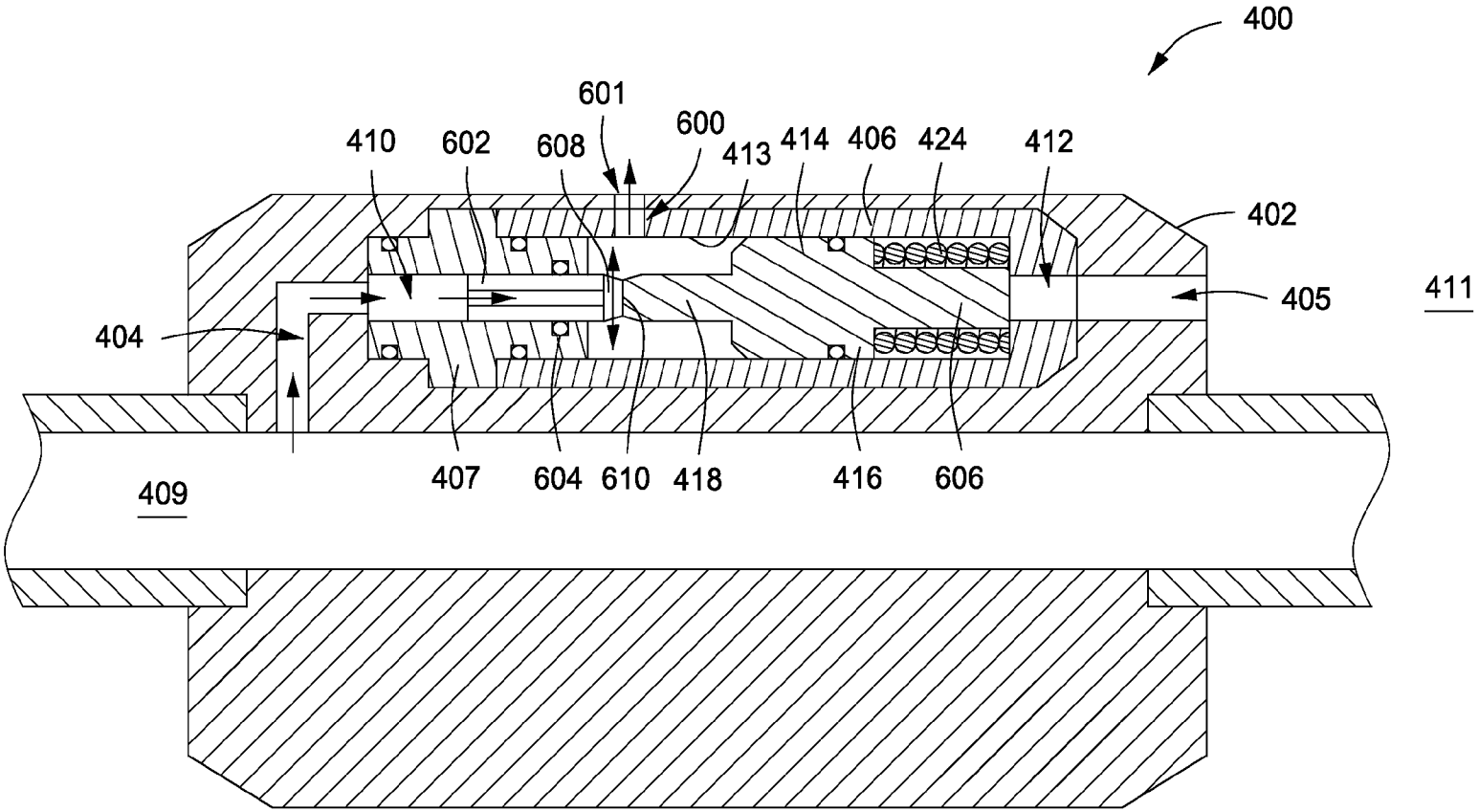
FIG. 9 depicts the inflow control device of FIG. 8 in an open configuration, according to one or more embodiments described.
Figure 10:
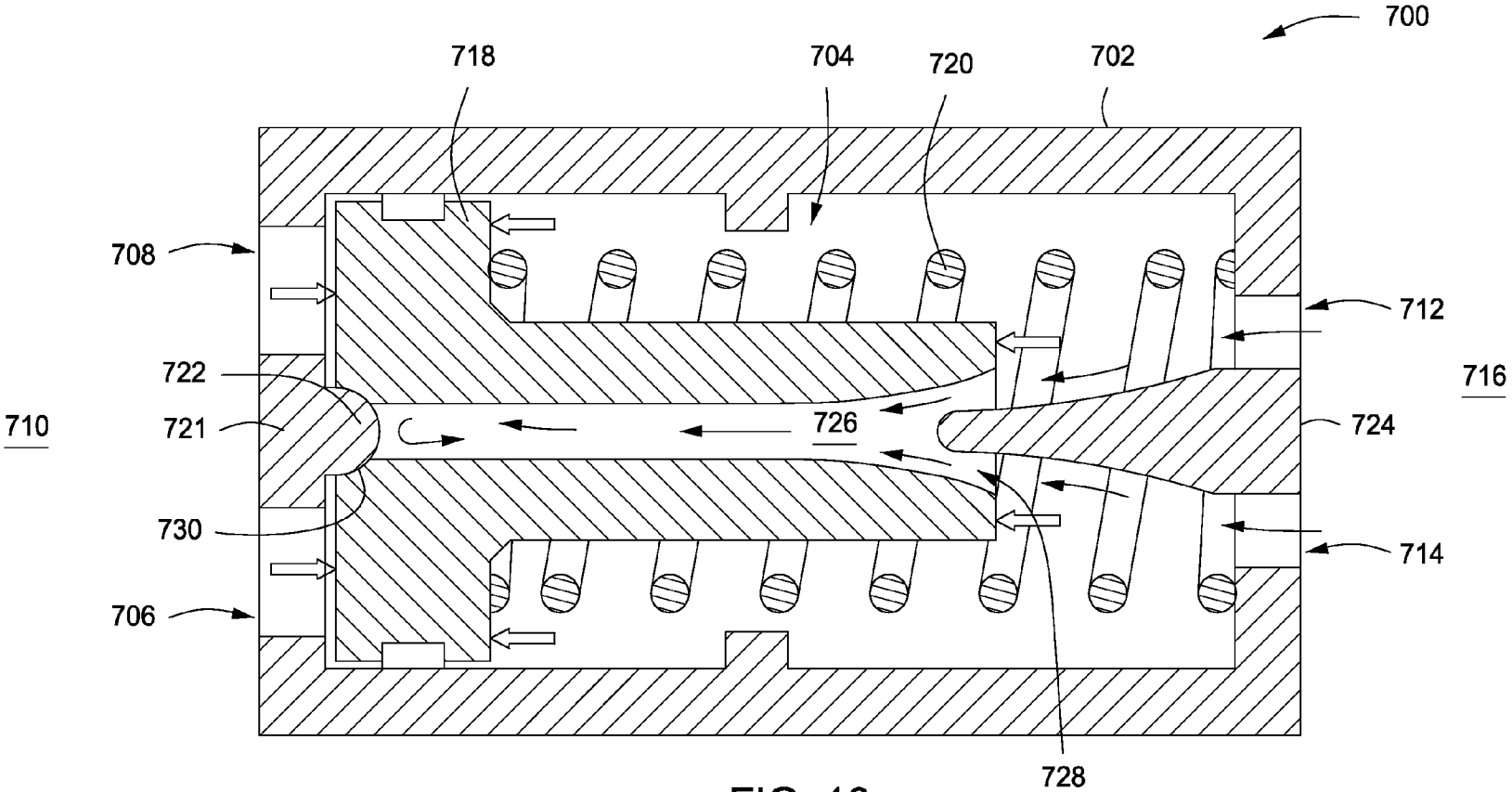
FIG. 10 depicts still another embodiment of the ICD, according to one or more embodiments described.

The finger 418 can extend farther than the groove 502 is deep. Accordingly, a pocket 508 can be defined between the valve seat 407 and the plunger 414. However, the finger 502 can surround the end 506 of the inlet 410, and can be sealed in the groove 502; thus, the plunger 414 can seal the inlet 410 when a negative or no pressure differential between the inlet 410 and the outlet 412. It will be appreciated that the finger 418 and the groove 502 could also be polygonal, elliptical, or any other suitable shape. Further, the valve seat 207 can include the face seal 422 (FIGS. 5 and 6) to further seal the plunger 414 with the valve seat 407. FIGS. 8 and 9 depict another illustrative embodiment of the ICD 400. The check valve 406 shown includes an outlet 600 extending outward from the recess 421. Further, the carrier includes a primary outlet 601 in fluid communication with the outlet 600 and the exterior area 411. As such, the through-passage 423 (FIGS. 4-7) can be omitted, as fluid can exit the check valve 406 without being required to traverse the plunger 414. This can allow the plunger 414 to be solidly constructed. As the through-passage 423 can be omitted, the choke 426 (FIGS. 4-7) can also be omitted; accordingly, to choke the flow, an inlet choke 602 can be seated in the inlet 410, which can be enlarged, as shown, to receive the inlet choke 602 therein. Further, the choke 602 can be stationary or, as shown, movable in the inlet 410 and can include a radially-oriented nozzle 608 and an axial face 610 that bears against the finger 418.

To stop the inlet 410, the finger 418 can also be sized to fit snugly and movably in the inlet 410. Further, in lieu of or in addition to the face seal 422, as shown in FIGS. 5 and 6, the check valve 406 can include a seal 604 disposed in the inlet 410. As such, the finger 418 fits in the inlet 410 and seals with the seal 604 when the check valve 406 is closed. Further, the plunger 414 can include an extension 606, which extends therefrom toward the outlet 412 of the check valve 406. As illustrated in FIG. 9, when the check valve 406 is open, the extension 606 covers the outlet 412. As the base 416 can be sealed with the wall 413, fluid can be generally prohibited from flowing around the plunger 414 and entering the outlet 412. It will be appreciated that the primary outlet 600 and the previously-described outlet 412 can both be included and can reference both sides of the plunger 414 to the pressure in the area 411 exterior to the carrier 402. Accordingly, the plunger 414 can avoid transmitting high loads on the choke 602 when the pressure differential between the area 411 exterior the carrier 402 and the main flowpath 409 is highly negative (i.e., when the pressure in the area 411 is much higher than in the main flow path 409). As pressure from the exterior area 411 pushes on both sides of the plunger 414 with equal force, the biasing force of the biasing member 424 provides the net force on the plunger 414, resulting in a manageable and predictable net force on the plunger 414 toward the valve seat 407. Accordingly, the biasing member 424 can keep the finger 418 in the inlet 410 and thus prevents reverse flow of fluid, despite the presence of such highly negative pressure differentials.

When the pressure in the main flowpath 409 increases with respect to the pressure in the area 411 exterior the carrier 402 (i.e., a positive pressure differential develops), the pressure differential can urge both the choke 602 and the finger 418 to move out of the inlet 410, as shown in FIG. 9. Further, the choke 602 can transmit the force applied thereon to the finger 418 via the engagement of the axial face 610 with the finger 418. Accordingly, the force from the positive pressure differential can overcome the biasing force applied by the biasing member 424 and push both the choke 602 and the finger 418 at least partially out of the inlet 410. As such, the nozzle 608 of the choke 600 can extend into the recess 421, thus allowing choked fluid to flow out through the nozzle 608. Thereafter, the fluid can flow out through the outlet 600, the primary outlet passage 601, and into the area 411.

FIG. 9 depicts another illustrative ICD 700, according to one or more embodiments. The ICD 700 can generally include a housing or carrier 702, with a check valve 704 disposed therein. The check valve 704 can define one or more inlets (two are shown: 706, 708) which can be fluidly coupled to one or more main flowpaths 710. The check valve 704 can also define one or more outlets (two shown: 712, 714), which can be fluidly coupled with an area 716 external to the carrier 702 and isolated from the main flowpath 710.

The check valve 704 can also include a plunger 718, a biasing member 720, a valve seat 721 with a finger 722 extending therefrom, and a flow constrictor 724. The plunger 718 can define a through-passage 726 therein, which can extend from a diverging end 728 to a mouth 730. The mouth 730 can be sized to receive the finger 722 and form a seal therewith. Although not shown, the check valve 704 can include one or more seals of any suitable type, such as crush seals, O-rings, etc., to assist in forming a fluid-tight seal between the plunger 718 and the valve seat 721. The diverging end 728 can be sized to receive the flow constrictor 724 therein. The flow constrictor 724 can be tapered, such that as the plunger 718 moves toward the flow constrictor 724, the flow constrictor 724 obstructs more of the through-passage 726. The diverging end 728 can be sized to receive some of the tapered flow constrictor 724, without substantially reducing the flowpath area with respect to a remainder 729 of the through-passage 726 and, thus, without substantially accelerating fluid flow in the end 728, around the flow constrictor 724. As more of the flow constrictor 724 is received in the through-passage 726, however, the unobstructed flowpath area in the end 728 can be reduced, thereby choking the flow.

In operation, the biasing member 720 provides a default position for the plunger 718, pushing the plunger 718 toward the finger 722 and in a sealed relationship therewith. Accordingly, if the pressure in the outlets 712, 714 is greater than, equal to, or negligibly less than the pressure in the inlets 706, 708, the plunger 708 remains sealed against the valve seat 721. As such, the check valve 704 prevents backflow from the outlets 712, 714 to the inlets 706, 708. As the pressure in the inlets 706, 708 increases with respect to the pressure in the outlets 712, 714, the force produced by such a positive pressure differential can overcome the biasing force applied by the biasing member 720 and by the pressure in the outlets 712, 714. Accordingly, when a predetermined pressure level in the inlets 706, 708 is reached, the plunger 708 can be urged away from the valve seat 721, such that the finger 722 no longer seals the through-passage 726. Fluid can then traverse the plunger 718 via the through-passage 726 and proceed to the outlets 712, 714. Under relatively low positive pressure differentials, the biasing member 720 can stop movement of the plunger 718. The flow constrictor 724 can thus avoid significantly choking the flow under such low positive pressure differential conditions, where choking may not be desired. However, as the positive pressure differential increases above a predetermined pressure level, the plunger 714 can proceed closer to the outlets 712, 714, thus receiving more of the flow constrictor 724 in the end 728 of the through-passage 726. Accordingly, the flowpath area exiting the through-passage 726 can be reduced, thereby choking the flow and providing for a relatively constant mass flow rate, despite the increased pressure differential.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention can be devised without departing from the basic scope thereof, and the scope thereof is determined by the claims that follow.

What is claimed is:

1. An apparatus for completing a wellbore, comprising:

a tubular body including a base pipe and an outer body disposed at least partially around the base pipe, wherein the base pipe defines an inner bore therein, and wherein a secondary flowpath is defined between the base pipe and the outer body;

a flow control valve coupled to the base pipe and configured to provide fluid communication between the inner bore and the secondary flowpath when in an open configuration and to prevent fluid communication therethrough when in a closed configuration;

one or more injection inflow control devices coupled to the outer body, the injection inflow control devices including one or more first check valves, flow restrictors, or a combination thereof, wherein the injection inflow control devices are configured to allow fluid to flow therethrough from the secondary flowpath to an exterior of the outer body, and to substantially block a reverse fluid flow therethrough; and one or more production inflow control devices coupled to the outer body, the production inflow control devices including one or more second check valves, flow restrictors, or a combination thereof, wherein the production inflow control devices are configured to allow fluid to flow therethrough from the exterior of the outer body to the secondary flowpath, and to substantially block a reverse fluid flow therethrough.

2. The apparatus of claim 1, wherein the flow control valve is interventionlessly actuable via a hydraulic signal, a pneumatic signal, a fiber optic signal, an electric signal, wireless telemetry, or actuable by a shifting tool or actuating device conveyed on a slick line, wireline, coiled tubing or pipe, or combination thereof.

3. The apparatus of claim 1, wherein the flow control valve comprises:

a sleeve covering an orifice providing fluid communication through the base pipe when the flow control valve is in the closed position and at least partially uncovering the orifice when the flow control valve is in the open position; and a ball or dart seat coupled to the sleeve and configured to receive a ball or dart to move the sleeve to at least partially uncover the orifice.

4. The apparatus of claim 1, further comprising a plurality of swell constrictors extending radially-outward from the tubular body, the first and second check valves each being positioned axially between two of the plurality of swell constrictors.

5. The apparatus of claim 1, wherein at least one of the first and second check valves includes a housing, an inlet, an outlet, a plunger disposed in the housing configured to obstruct the inlet, and a spring biasing the plunger toward the inlet, wherein the plunger is movable in response to a positive pressure differential to allow fluid flow from the inlet to the outlet.

6. The apparatus of claim 1, wherein the at least one of the first and second check valves includes a choke disposed to regulate mass flow at least through the inlet, the outlet, or both.

7. The apparatus of claim 1, wherein at least one of the one or more production and injection inflow control devices includes a variable choke configured to restrict flow above a predetermined pressure differential to provide a generally constant mass flow rate through an inlet thereof.

8. A completion system for a wellbore, comprising:

one or more distal completion segments including:

a base pipe defining an inner bore therein;

an outer body disposed at least partially around the base pipe, wherein a secondary flowpath is defined between the base pipe and the outer body;

a flow control valve coupled to the base pipe and configured to provide fluid communication between the inner bore and the secondary flowpath when in an open configuration and to prevent fluid communication therethrough when in a closed configuration;

one or more injection inflow control devices coupled to the outer body and configured to allow fluid to flow from within the one or more distal completion segments to a region outside the one or more distal completion segments, and to prevent reverse flow therethrough; and one or more production inflow control devices coupled to the outer body and configured to allow fluid to flow from the region outside the one or more distal completion segments to within the one or more distal completion segments, and to prevent reverse fluid flow therethrough; and a proximal completion segment coupled with at least one of the one or more distal completion segments.

9. The system of claim 8, wherein the proximal completion segment is configured to engage and couple to at least one of the one or more distal completion segments after being deployed into the wellbore.

10. The system of claim 8, wherein the flow control valve includes an orifice and a valve element configured to cover the orifice when the flow control valve is closed and to at least partially uncover the orifice when the flow control valve is open.

11. The system of claim 10, wherein the flow control valve further includes a ball or dart seat coupled to the valve element and configured to receive a ball or dart to slide the valve element and open the flow control valve.

12. The system of claim 11, wherein the one or more distal completion segments includes a plurality of distal completion segments each having one or more flow control valves including a ball seat, the ball seats being sized progressively smaller proceeding toward a distal end of the completion system.

13. The system of claim 10, wherein the one or more production and injection inflow control devices each include one or more one-way check valves fluidly communicating with the inner bore of the one or more distal completion segments when the flow control valve is open.

14. The system of claim 8, wherein the proximal completion segment includes a flow control valve, an injection inflow control device configured to allow one-way flow from within the proximal completion segment to a region exterior to the proximal completion segment and a production inflow control device configured to allow one-way flow from the area external to the proximal completion segment to within the proximal completion segment.

15. A method for completing a wellbore, comprising:

running one or more distal completion segments into a wellbore, the distal completion segments including:

a base pipe defining an inner bore therein;

an outer body disposed at least partially around the base pipe, wherein a secondary flowpath is defined between the base pipe and the outer body;

a flow control valve coupled to the base pipe and configured to provide fluid communication between the inner bore and the secondary flowpath when in an open configuration and to prevent fluid communication therethrough when in a closed configuration;

an injection inflow control device coupled to the outer body and configured to allow fluid to flow therethrough from the secondary flowpath to an exterior of the outer body and to prevent fluid from flowing therethrough from the exterior of the outer body to the secondary flowpath; and a production inflow control device coupled to the outer body and configured to allow fluid to flow therethrough from the exterior of the outer body to the secondary flowpath and to prevent fluid from flowing therethrough from the secondary flowpath to the exterior of the outer body;

running a proximal completion segment into the wellbore using a production tubing string after running the one or more distal completion segments; and coupling a distal end of the production tubing string with the one or more distal completion segments in the wellbore.

16. The method of claim 15, further comprising performing one or more injection operations and one or more production operations without removing the distal completion segments.

17. The method of claim 15, further comprising:

actuating the flow control valve of the one or more distal completion segments to open the flow control valve;

injecting a fluid into the wellbore via the flow control valve and through the injection inflow control device, the injection inflow control device including at least one check valve; and producing a fluid from the wellbore through the production inflow control device, the production inflow control device including a check valve.

18. The method of claim 17, further comprising actuating a sequence of flow control valves in the one or more distal completion segments by dropping progressively smaller balls or darts through the production tubing.

19. The method of claim 17, further comprising actuating a sequence of flow control valves in the one or more distal or proximal completion segments by dropping same size balls or darts through the production tubing.

20. The method of claim 17, further comprising actuating a sequence of flow control valves in the one or more distal or proximal completion segments by engaging a flow control valve actuating device conveyed on slick line, wireline, coiled tubing or pipe.

* * * * *